US006588697B2

(12) United States Patent
Kitayama

(10) Patent No.: US 6,588,697 B2
(45) Date of Patent: Jul. 8, 2003

(54) SPOOL STRUCTURE

(75) Inventor: Eiichi Kitayama, Tokyo-To (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 09/917,900

(22) Filed: Jul. 31, 2001

(65) Prior Publication Data

US 2002/0017588 A1 Feb. 14, 2002

(30) Foreign Application Priority Data

Aug. 1, 2000 (JP) ..... 2000-232595

(51) Int. Cl.[7] ..... B65H 75/14; B65H 75/18

(52) U.S. Cl. ..... 242/608.6; 242/118.61; 242/118.7; 242/610.6

(58) Field of Search ..... 242/608.6, 610.6, 242/118.61, 118.7

(56) References Cited

U.S. PATENT DOCUMENTS 1,987,990 A * 1/1935 Clinton ..... 242/118.61
2,720,179 A * 10/1955 Strocco ..... 242/118.61 X
3,184,053 A * 5/1965 Eldridge ..... 242/118.61 X
3,520,490 A * 7/1970 Williams ..... 242/118.7 X
4,128,215 A * 12/1978 Underwood ..... 242/608.6
4,874,139 A * 10/1989 Kewin ..... 242/610.6 X
5,335,873 A * 8/1994 Harris et al. ..... 242/608.6 X
6,283,323 B1 * 9/2001 Endo et al. ..... 242/608.6 X

* cited by examiner

*Primary Examiner*—Kathy Matecki
*Assistant Examiner*—Minh-Chau Pham
(74) *Attorney, Agent, or Firm*—Parkhurst & Wendel, L.L.P.

(57) ABSTRACT

A spool structure of the invention includes a cylindrical core, which has a smooth outer surface and an inner surface. An engaging part is formed on the inner surface. A flange is connected to the core. The flange has a jaw part that can be arranged at a side end of the core, and a nail part that can engage with the engaging part of the inner surface of the core.

10 Claims, 7 Drawing Sheets

SPOOL STRUCTURE

BACKGROUND OF THE INVENTION

1. Field of the Invention

This invention relates to a spool structure around which a belt-shaped object, such as an image-receiving sheet used for sublimation printing, is wound.

2. Description of the Related Art

FIG. 6 is a perspective view of a conventional spool structure.

The conventional spool structure 20 has a core 21, a first flange 22 and a second flange 23.

An image-receiving sheet, which is used for sublimation printing, is adapted to be wound around the core 21. The core 21 has a positioning groove 21*a* at a first end portion 21-1 on the side of the first flange 22, and a positioning groove 21*d* at a second end portion 21-2 on the side of the second flange 23. The core 21 also has through holes 21*e* and 21*f* appearing at an outside surface thereof, on which the image-receiving sheet is wound.

The first flange 22 has: a jaw part 22*c* that can protect and guide the image-receiving sheet wound around the core 21; a gear part 22*b* that can transmit a driving force from a printing apparatus not shown; a shaft part 22*a*; and a fitting part 22*d* that can be fitted with the core 21. The jaw part 22*c*, the gear part 22*b*, the shaft part 22*a* and the fitting part 22*d* are integrally formed.

The second flange 23 has: a jaw part 23*c* that can protect and guide the image-receiving sheet wound around the core 21, similarly to the jaw part 22*c*; a shaft part 23*a*; and a fitting part 23*d* that can be fitted with the core 21. The jaw part 23*c*, the shaft part 23*a* and the fitting part 23*d* are integrally formed.

The fitting part 22*d* has an outside diameter suitable for fitting with the inside diameter of the core 21. A positioning projection (not shown) is formed at a location corresponding to the positioning groove 21*a*.

Similarly, the fitting part 23*d* has an outside diameter suitable for fitting with the inside diameter of the core 21. A positioning projection 23*f* is formed at a location corresponding to the positioning groove 21*d*.

The first and second flanges 22 and 23 have nail parts 22*g* and 23*g*, respectively. The nail parts 22*g* and 23*g* are adapted to engage with the holes 21*e* and 21*f* provided in the core 21 by using their own elasticity, respectively. Thus, the first and second flanges 22 and 23 are adapted to be surely fixed to the core 21 not to come off the core 21.

In the conventional spool structure 20, the through holes 21*e* and 21*f* appear on the surface of the core 21 on which the image-receiving sheet is wound. Thus, there is a problem that the shapes of the holes 21*e* and 21*f* may be transferred to the image-receiving sheet and may remain therein.

As the image-receiving sheet, a polypropylene foam film or a polyethylene terephthalate foam film, which are superior in cushioning performance and thermal-insulating performance, are used in order to uniformly and efficiently transfer dye to a receiving layer by means of a pressing contact with a thermal head. In the case, the shapes of the holes 21*e* and 21*f* may be transferred more easily, for example the shapes of the holes 21*e* and 21*f* may be transferred even to (and may remain in) an outermost part of the wound image-receiving sheet.

In addition, a surface for sublimation printing is a glossy surface. Thus, if the shapes of the through holes 21*e* and 21*f* remain in the image-receiving sheet, the shapes (traces) are very conspicuous, so that quality as printed matter may be deteriorated.

When the first and second flanges 22 and 23 are removed from the core 21, the nail parts 22*g* and 23*g* have to be pressed via the through holes 21*e* and 21*f*. Thus, it is necessary for the through holes 21*e* and 21*f* to pass through the surface of the core 21 for winding the image-receiving sheet. In other words, if the through holes 21*e* and 21*f* are buried, the first and second flanges 22 and 23 can not be removed from the core 21.

SUMMARY OF THE INVENTION

Therefore, the object of this invention is to provide a spool structure wherein it is unnecessary to provide an unevenness pattern or a hole appearing on an outside surface of a core, on which an image-receiving sheet or the like is wound, and wherein a flange can be surely combined normally and easily removed if necessary.

The invention is a spool structure including: a cylindrical core having a smooth outer surface, and an inner surface with a engaging part; and a flange having a jaw part that can be arranged at a side end of the core, and a nail part that can engage with the engaging part of the inner surface of the core.

According to the invention, since the engaging part is provided on the inner surface of the core, the outer surface of the core can be completely smooth.

For example, the engaging part consists of a concavity having a bottom surface.

In addition, for example, the nail part consists of an elastic member that is urged toward the engaging part of the inner surface of the core so as to engage with the engaging part, and the nail part is adapted to be released from the engaging part when a predetermined releasing force is acted so as to move the nail part away from the engaging part.

In the case, preferably, the jaw part has a through hole that allows an access from an area opposite to the core with respect to the jaw part to a surface of the nail part on a side of the engaging part. Thus, by using a jig such as a bar or a stick, the predetermined releasing force may be given to the nail part more easily so as to move the nail part away from the engaging part.

In addition, in the case, preferably, the nail part extends from a side end of the core to the engaging part along the inner surface of the core, the nail part has a tip part that can engage with the engaging part, the core has a groove at an area in the inner surface facing the surface of the nail part on the side of the engaging part, and the groove of the core can communicate with the through hole of the jaw part. Thus, the predetermined releasing force may be given to the nail part further more easily so as to move the nail part away from the engaging part.

More preferably, the nail part has a inclined surface rising toward the tip part at a root-side-adjacent portion adjacent to the tip part, and the inclined surface can be contained in the groove of the core. Thus, by causing an external force in a direction of the rotation axis of the core to act on the inclined surface by using a jig such as a bar or a stick, the predetermined releasing force may be given to the nail part more easily to move the nail part away from the engaging part.

Alternatively, this invention is a spool structure including: a cylindrical core having a smooth outer surface, and an inner surface with a first engaging part and a second engaging part; and a flange having a jaw part that can be arranged at a side end of the core, a first nail part that can engage with the first engaging part of the inner surface of the core, and a second nail part that can engage with the second engaging part of the inner surface of the core.

According to the invention, since the plurality of engaging parts are provided on the inner surface of the core, the outer surface of the core can be completely smooth, and the core and the flange can be connected more surely.

For example, each of the first and second engaging parts consists of a concavity having a bottom surface.

In addition, for example, the first nail part consists of an elastic member that is urged toward the first engaging part of the inner surface of the core so as to engage with the first engaging part, the first nail part is adapted to be released from the first engaging part when a first predetermined releasing force is acted so as to move the first nail part away from the first engaging part, the second nail part consists of an elastic member that is urged toward the second engaging part of the inner surface of the core so as to engage with the second engaging part, and the second nail part is adapted to be released from the second engaging part when a second predetermined releasing force is acted so as to move the second nail part away from the second engaging part.

In the case, preferably, the jaw part has a first through hole that allows an access from an area opposite to the core with respect to the jaw part to a surface of the first nail part on a side of the first engaging part and a second through hole that allows an access from the area opposite to the core with respect to the jaw part to a surface of the second nail part on a side of the second engaging part.

In addition, in the case, preferably, the first nail part extends from a side end of the core to the first engaging part along the inner surface of the core, the first nail part has a first tip part that can engage with the first engaging part, the second nail part extends from a side end of the core to the second engaging part along the inner surface of the core, the second nail part has a second tip part that can engage with the second engaging part, the core has a first groove at a first area in the inner surface facing the surface of the first nail part on the side of the first engaging part and a second groove at a second area in the inner surface facing the surface of the second nail part on the side of the second engaging part, the first groove of the core can communicate with the first through hole of the jaw part, and the second groove of the core can communicate with the second through hole of the jaw part.

More preferably, the first nail part has a first inclined surface rising toward the first tip part at a first root-side-adjacent portion adjacent to the first tip part, the first inclined surface can be contained in the first groove of the core, the second nail part has a second inclined surface rising toward the second tip part at a second root-side-adjacent portion adjacent to the second tip part, and the second inclined surface can be contained in the second groove of the core.

Preferably, the flange consists of one integrally molded resin member.

For example, an image-receiving sheet used for sublimation printing is adapted to be wound around the outer surface of the core. Even in the case, a shape of an unevenness pattern or a hole is never transferred to the image-receiving sheet, so that beautiful printed matter can be obtained.

BEST MODE FOR CARRYING OUT THE INVENTION

Embodiments of the invention are explained in more detail with reference to the drawings.

First Embodiment

Figure 1:
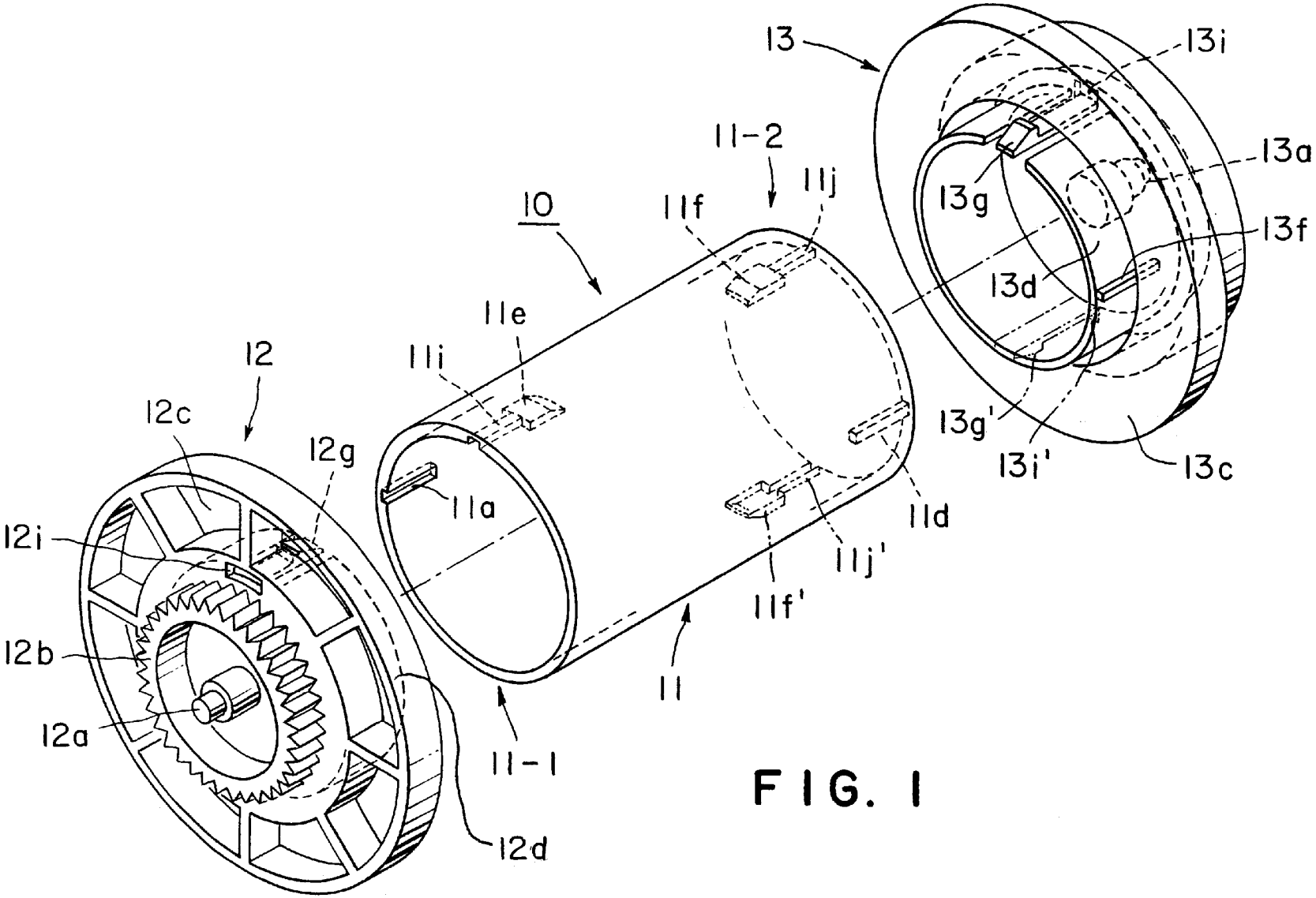
FIG. 1 is a perspective view of a spool structure according to a first embodiment of the invention.

FIG. 1 is a perspective view of a spool structure according to a first embodiment of the invention.

The spool structure 10 has a core 11, a first flange 12 and a second flange 13.

Figure 7:
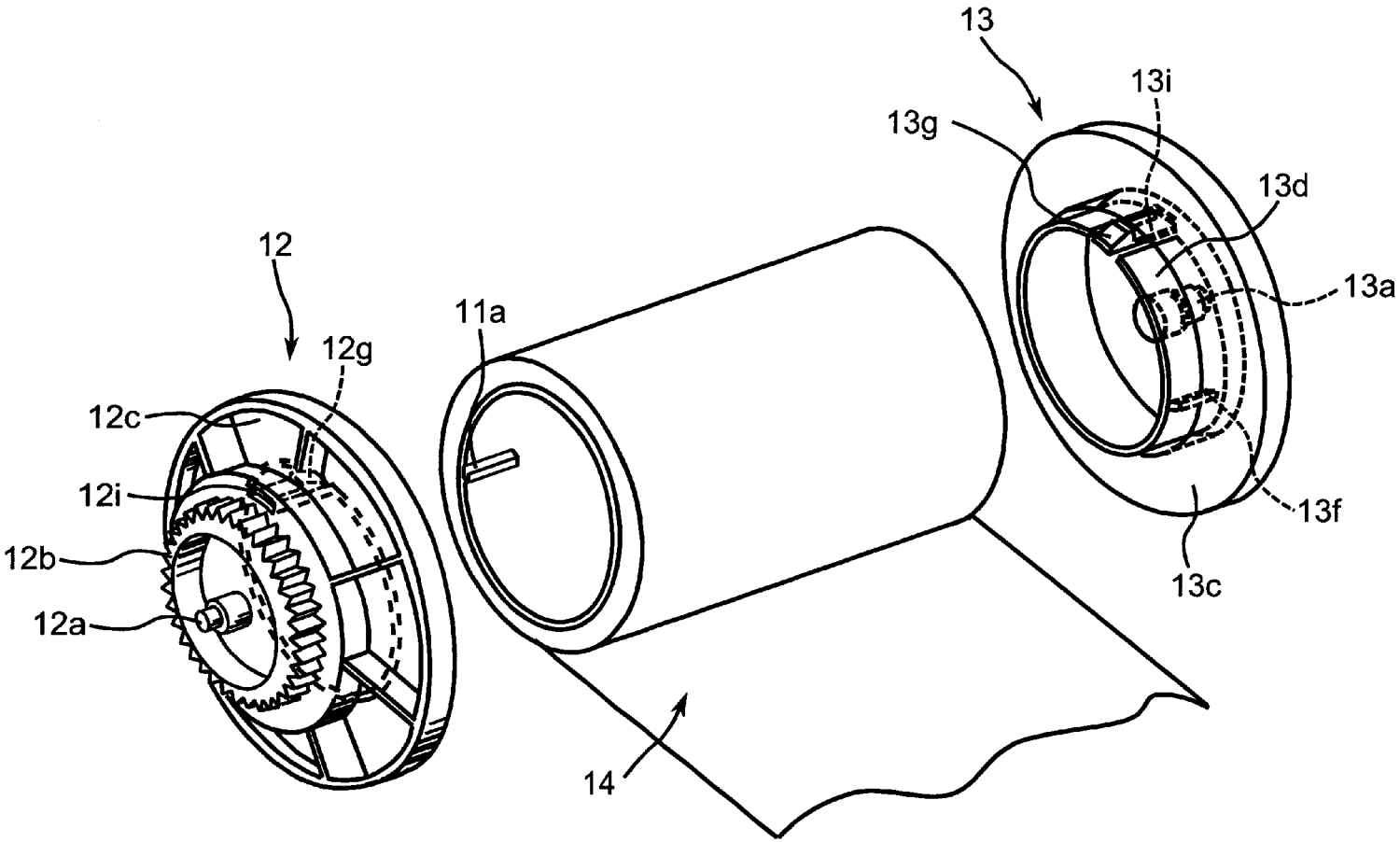
FIG. 7 is a perspective view of the spool structure shown in FIG. 1 with an image-receiving sheet.

FIG. 7 shows an image-receiving sheet 14, which is used for sublimation printing, adapted to be wound around the core 11. The core 11 has a positioning groove 11*a* at a first end portion 11-1 on the side of the first flange 12, and a positioning groove lid at a second end portion 11-2 on the side of the second flange 13.

The core 11 also has not-through i.e. bottom-having concave parts (concavities) 11*e* and 11*f* in an inner surface thereof, as engaging parts, instead of the conventional through holes 21*e* and 21*f*. Thus, an outside surface of the core 11 is very smooth.

In addition, releasing grooves 11*i* and 11*j*, which are narrower than the concave parts 11*e* and 11*f*, are formed from the concave parts 11*e* and 11*f* to the end portions 11-1 and 11-2, respectively.

The first flange 12 has: a jaw part 12*c* that can protect and guide the image-receiving sheet wound around the core 11; a gear part 12*b* that can transmit a driving force from a printing apparatus not shown; a shaft part 12*a*; and a fitting part 12*d* that can be fitted with the core 11. The jaw part 12*c*, the gear part 12*b*, the shaft part 12*a* and the fitting part 12*d* are integrally molded.

The second flange 13 has: a jaw part 13*c* that can protect and guide the image-receiving sheet wound around the core 11, similarly to the jaw part 12*c*; a shaft part 13*a*; and a fitting part 13*d* that can be fitted with the core 11. The jaw part 13*c*, the shaft part 13*a* and the fitting part 13*d* are integrally molded.

The fitting part 12*d* has an outside diameter suitable for fitting with the inside diameter of the core 11. A positioning projection (not shown) is formed at a location corresponding to the positioning groove 11*a*.

Similarly, the fitting part 13*d* has an outside diameter suitable for fitting with the inside diameter of the core 11. A positioning projection 13*f* is formed at a location corresponding to the positioning groove 11*d*.

The first and second flanges 12 and 13 have nail parts 12*g* and 13*g*, respectively. The nail parts 12*g* and 13*g* are adapted to engage with the concave parts 11*e* and 11*f* provided in the core 11 by using their own elasticity, respectively.

Figure 2:
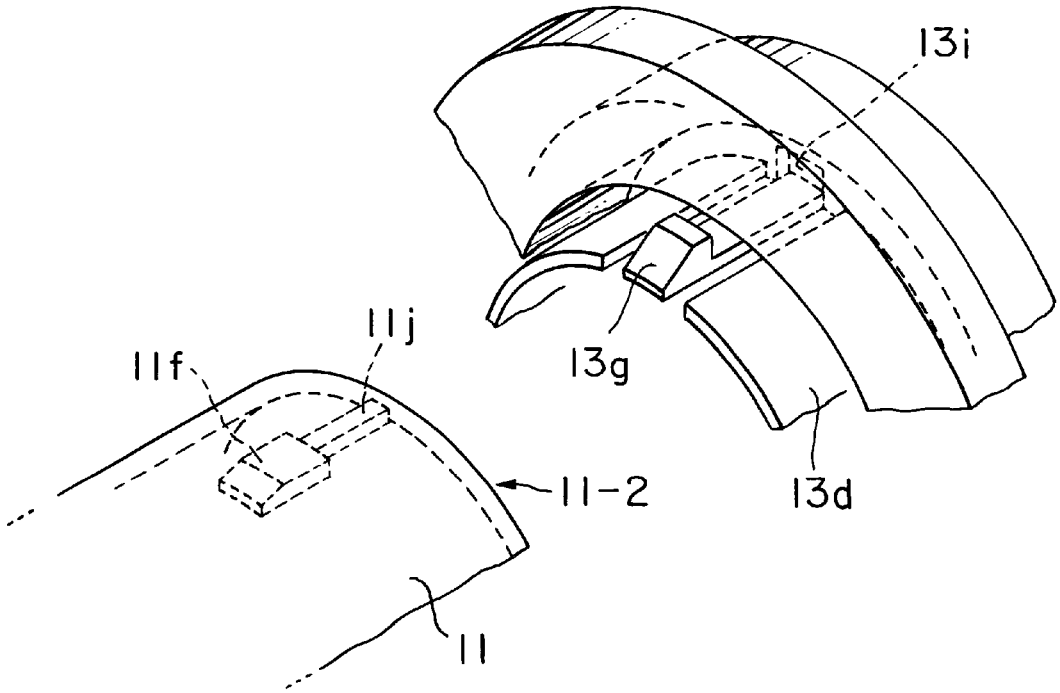
FIG. 2 is an enlarged view of the vicinity of the concave part and the nail part.

FIG. 2 is an enlarged view of the vicinity of the concave part 11*f* and the nail part 13*g*. The vicinity of the concave part 11*e* and the nail part 12*g* is similar to the vicinity of the concave part 11*f* and the nail part 13*g*. Thus, the following explanation is given only to the vicinity of the concave part 11*f* and the nail part 13*g*, that is, the side of the second flange 13, representatively.

The second flange 13 has a through hole 13*i* at a root of the nail part 13*g*. The through hole 13*i* extends from an outside surface of the jaw part 13*c* to an upper surface of the nail part 13*g*.

When the second flange 13 is combined with the core 11, the positioning groove 11*d* and the positioning projection 13*f* are fit in with each other. At that time, the nail part 13*g* is fit into the concave part 11*f*, and the fitting part 13*d* is fit with the inside diameter of the core 11. Thus, the second flanges 13 is surely fixed to the core 11 not to come off the core 11.

Figure 3:
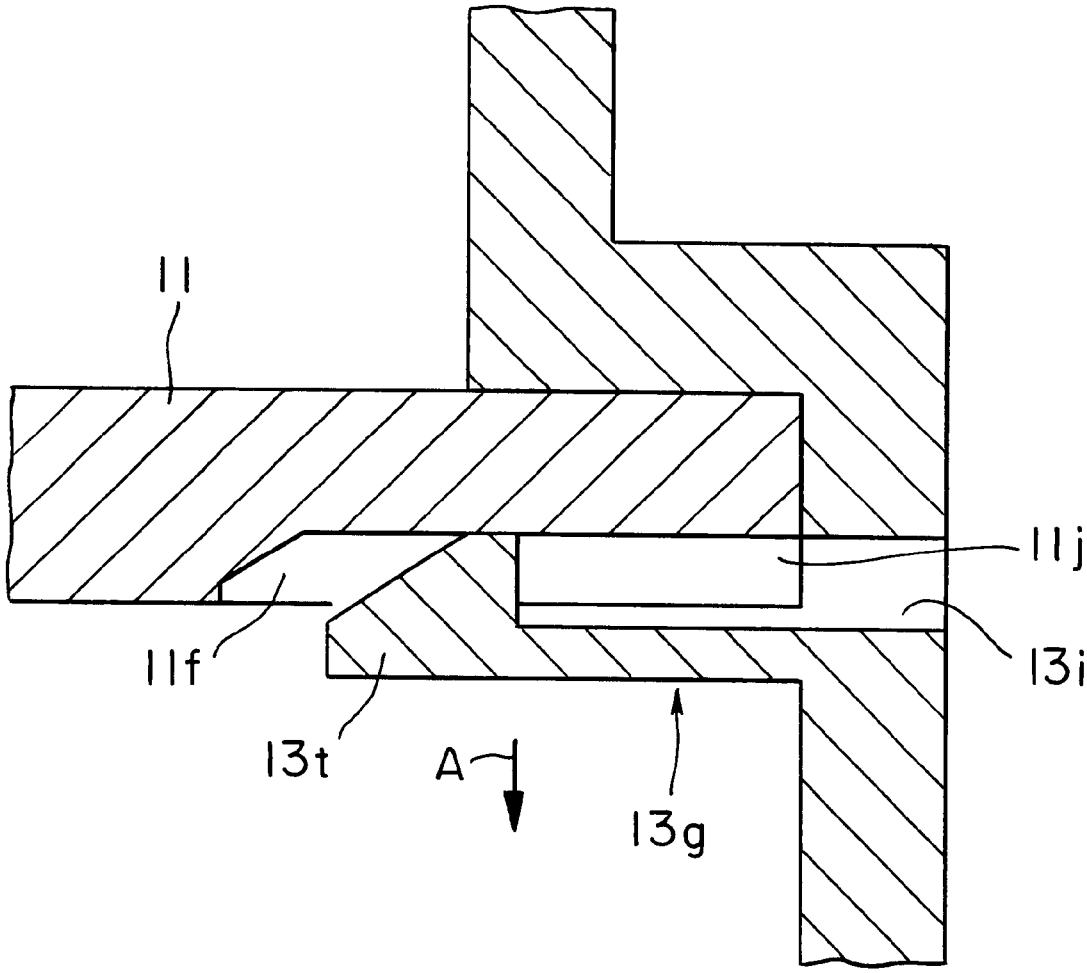
FIG. 3 is a cross sectional view of the vicinity of the nail part in the first embodiment.

FIG. 3 is a cross sectional view of the vicinity of the nail part 13*g*.

When the second flange 13 is removed from the core 11, a jig such as a bar or a stick is passed through the through hole 13*i* and the releasing groove 11*j*. Then, the nail part 13*g* is pressed in a direction indicated by an arrow A by the jig, so that the engagement of the nail part 13*g* and the concave part 11*f* is released.

According to the embodiment, it is unnecessary to provide an unevenness pattern or a hole that appears on an outside surface of a core 11. Thus, a shape of the outside surface of the core 11 is never transferred to the image-receiving sheet, so that the shape never remains in the image-receiving sheet.

In addition, the first and second flanges 12, 13 and the core 11 are strongly fixed in their combined state. On the other hand, when the first and second flanges 12, 13 are removed from the core 11, they are easily removed by using the through holes 12*i*, 13*i* and the releasing grooves 11*i*, 11*j*.

In addition, this embodiment can be made by the same number of components as the conventional one and substantially the same manufacturing method as the conventional one, so that this embodiment can be made at small cost.

Second Embodiment

In the first embodiment, when the first and second flanges 12, 13 are removed from the core 11, the nail part 13*g* is moved (evacuated) in the direction indicated by the arrow A by using the stick-like jig. However, if the spool structure is small-sized, the through hole 13*i* and the releasing groove 11*j* are also small-sized. In the case, it is difficult to move the nail part 13*g* well. In the second embodiment, even if the spool structure is small-sized, the engagement of the nail part 13*g* and the concave part 11*f* can be released more easily.

Figure 4A:
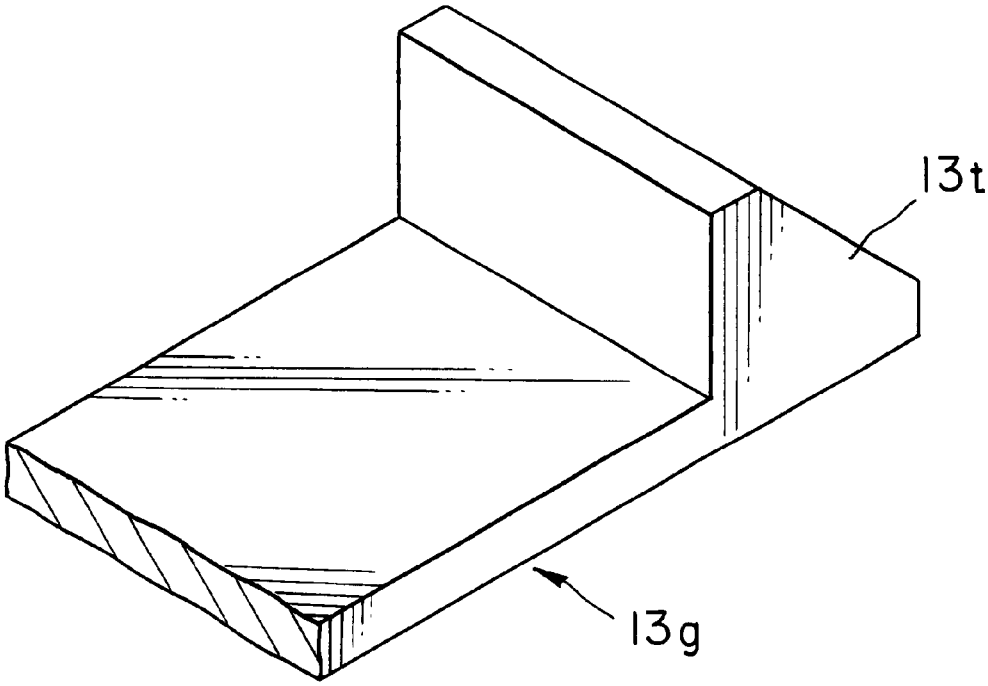
FIG. 4A is a perspective view of the vicinity of the tip part of the nail part in the first embodiment.
Figure 4B:
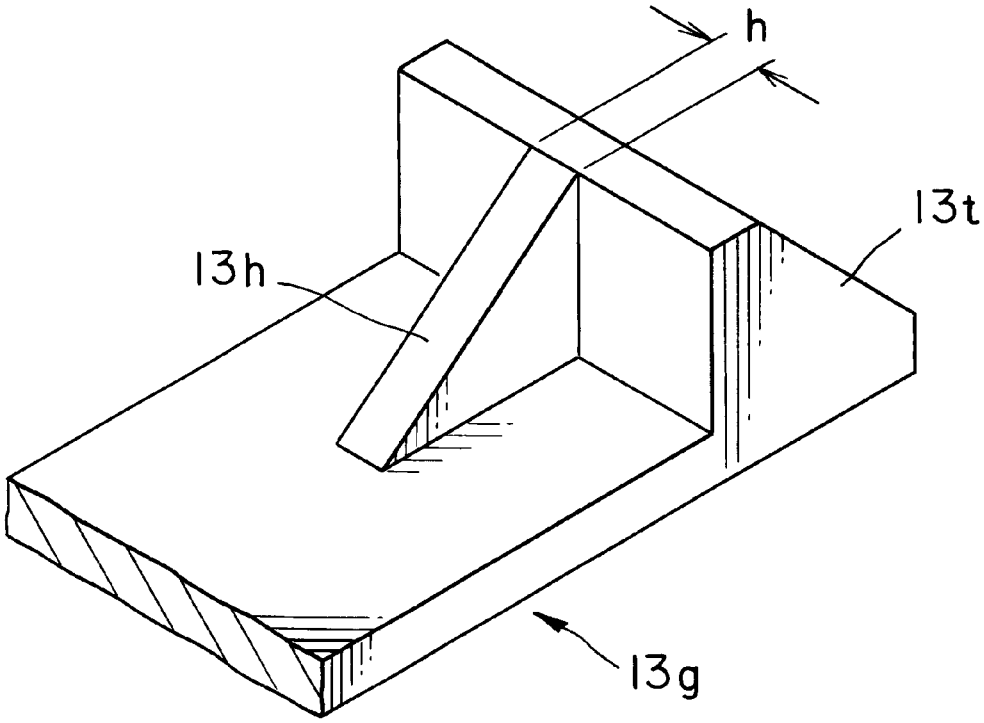
FIG. 4B is a perspective view of the vicinity of the tip part of the nail part in the second embodiment.

FIG. 4A is an enlarged view of the nail part 13*g* in the first embodiment, and FIG. 4B is an enlarged view of the nail part 13*g* in the second embodiment.

In the second embodiment, an inclined surface 13*h* is newly added at a back-side (root-side-adjacent) portion adjacent to a tip swell part 13*t* of the nail part 13*g*. The inclined surface 13*h* rises toward the tip swell part 13*t*. A width h of the inclined surface 13*h* is narrower than that of the releasing groove 11*j*. Thus, the inclined surface 13*h* can be contained in the releasing groove 11*j*.

Other structure of the second embodiment is substantially the same as the first embodiment. In the second embodiment, the same numeral references correspond to the same elements as the first embodiment. The explanation of the same elements is not repeated.

Figure 5:
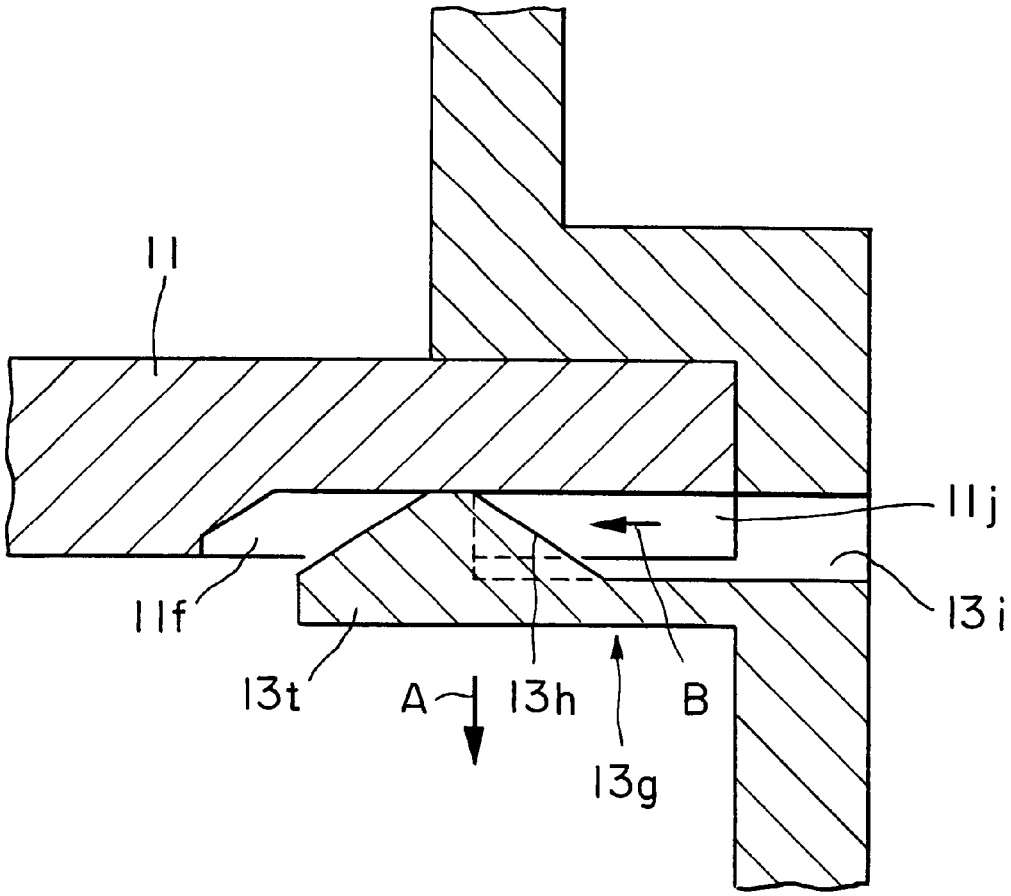
FIG. 5 is a cross sectional view of the vicinity of the nail part in the second embodiment.
Figure 6:
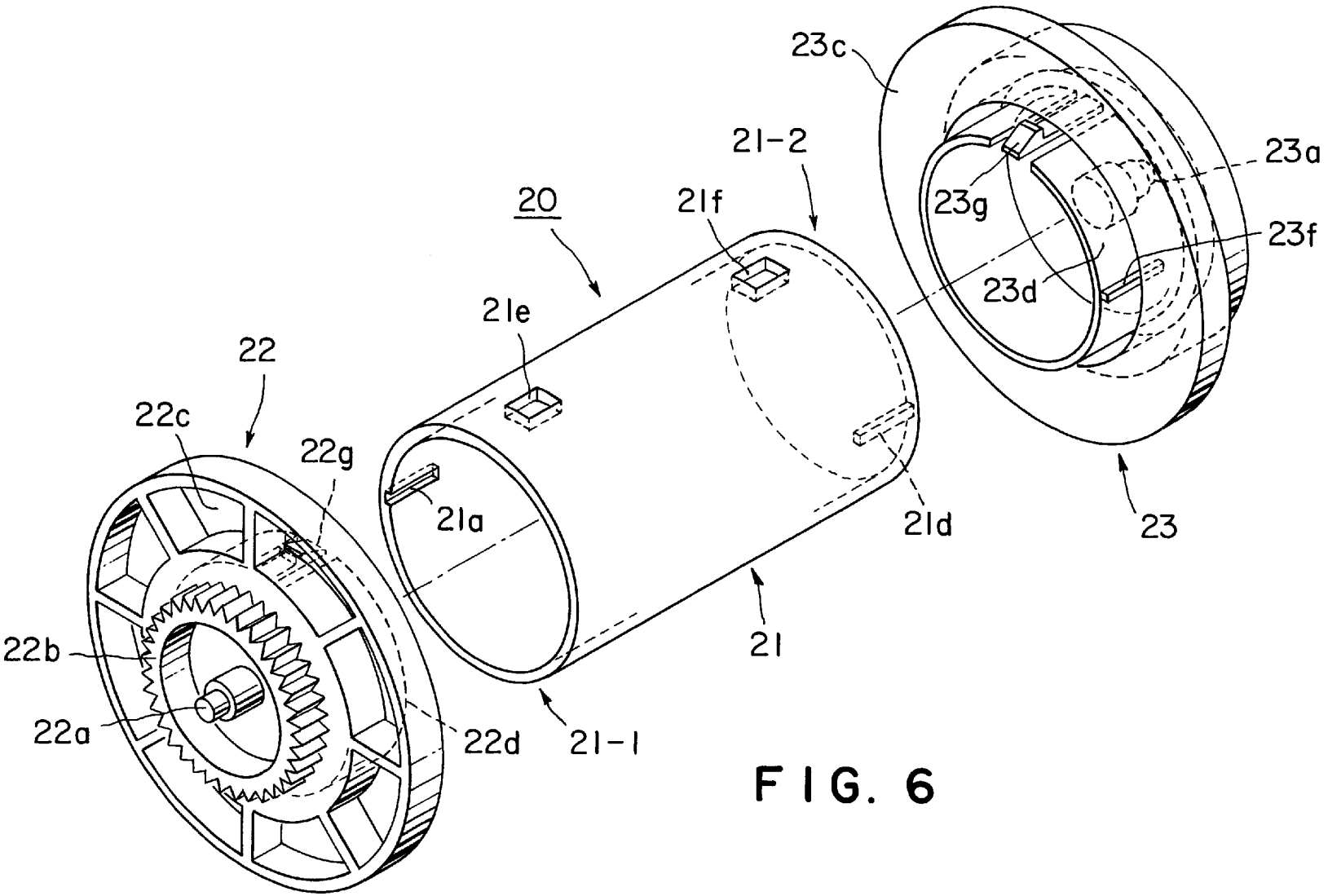
FIG. 6 is a perspective view of a conventional spool structure.

FIG. 5 is a cross sectional view of the vicinity of the nail part 13*g* in the second embodiment.

In the second embodiment, when the second flange 13 is removed from the core 11, a stick-like jig is passed through the through hole 13*i* and the releasing groove 11*j*. Then, the inclined surface 13*h* is pressed in a direction indicated by an arrow B by means of the jig. Thus, a component force, which can press the nail part 13*g* in the direction indicated by the arrow A, is generated by the inclined surface 13*h*. Therefore, an operator can release the engagement of the nail part 13*g* and the concave part 11*f* only by pushing the jig in the direction indicated by the arrow B.

Herein, if the inclined surface 13*h* is provided, a length of a bendable portion of the nail part 13*g* is substantially shortened. Thus, it is preferable to design the length of the nail part 13*g*, taking that point into consideration.

In addition, the side of the first flange 12 may be similar to the side of the second flange 13 described above.

As described above, according to the second embodiment, since the inclined surface 13*h* is provided, the operation of removing the first and second flanges 12 and 13 from the core 11 can be carried out more simply.

Modified Possible Embodiment

This invention is not limited by the above embodiments. The above embodiments may be modified or changed variously.

In the above embodiments, the core 11 is adapted to wind the image-receiving sheet used for sublimation printing. However, the core 11 may be adapted to wind another band-shaped, belt-shaped or sheet-like object.

In addition, in the above embodiments, one set of the nail part and the engaging part is provided for each end of the core 11. However, a plurality of sets of the nail part and the engaging part may be provided for each end of the core 11. For example, a second nail part 13*g*', a second through hole 13*i*', a second concave part 11*f*' and a second releasing groove 11*j*' may be provided, as shown in FIG. 1. In the case, a plurality of jigs, which can respectively release engagements of the plurality of nail parts, may be prepared independently. Alternatively, an integral jig including a plurality of stick-like portions may be prepared.

What is claimed is:

1. A spool structure comprising;

a cylindrical core having a hole-free outer surface and an inner surface with an engaging part, and a flange having a jaw part for location at an end of the core, and a nail part for engaging the engaging part of the inner surface of the core, wherein:

the nail part comprises an elastic member extending toward the engaging part of the inner surface of the core to engage with the engaging part, the nail part is adapted to be released from the engaging part when a predetermined releasing force is applied to the nail part to move the nail part away from the engaging part, the jaw part has a through hole for access from an area opposite the core with respect to the jaw part to a surface of the nail part on a side of the engaging part, the nail part extends from the end of the core to the engaging part along the inner surface of the core, the nail part has a tip part for engaging the engaging part, the core has a groove at an area in the inner surface facing a surface of the nail part on a side of the engaging part, and the groove of the core is for communication with the through hole of the jaw part.

2. A spool structure according to the claim 1, wherein the engaging part comprises a concavity having a bottom surface.

3. A spool structure according to claim 1, wherein:

the nail part has an inclined surface rising in a direction away from the core end from a portion adjacent the tip part toward the tip part, and the inclined surface is for containment in the groove of the core.

4. A spool structure according to the claim 1, wherein the flange comprises one integrally molded resin member.

5. A spool structure according to the claim 1, further comprising an image-receiving sheet, the image-receiving sheet for sublimation printing and adapted to be wound around the outer surface of the core.

6. A spool structure comprising;

a cylindrical core having a hole-free outer surface and an inner surface with a first engaging part and a second engaging part, and a flange having a jaw part for location at an end of the core, a first nail part for engaging with the first engaging part of the inner surface of the core, and a second nail part for engaging with the second engaging part of the inner surface of the core, wherein the first nail part comprises an elastic member extending toward the first engaging part of the inner surface of the core to engage with the first engaging part, the first nail part is adapted to be released from the first engaging part when a first predetermined releasing force is applied to the first nail part to move the first nail part away from the first engaging part, the second nail part, comprises an elastic member for urging toward the second engaging part of the inner surface of the core to engage with the second engaging part, the second nail part is adapted to be released from the second engaging part when a second predetermined releasing force is applied to the second nail part to move the second nail part away from the second engaging part, the jaw part has a first through hole for access from an area opposite the core with respect to the jaw part to a surface of the first nail part on a side of the first engaging part, and a second through hole for access from the area opposite the core with respect to the jaw part to a surface of the second nail part on a side of the second engaging part, the first nail part extends from the end of the core to the first engaging part along the inner surface of the core, the first nail part has a first tip part for engaging with the first engaging part, the second nail part extends from the end of the core to the second engaging part along the inner surface of the core, the second nail part has a second tip part for engaging with the second engaging part, the core has a first groove at a first area in the inner surface facing the surface of the first nail part on the side of the first engaging part, and a second groove at a second area in the inner surface facing the surface of the second nail part on the side of the second engaging part, the first groove of the core is for communication with the first through hole of the jaw part, and the second groove of the core is for communication with the second through hole of the jaw part.

7. A spool structure according to the claim 6, wherein:

each of the first and second engaging parts comprises a concavity having a bottom surface.

8. A spool structure according to the claim 6, wherein:

the first nail part has a first inclined surface rising in a direction away from the core end from a portion adjacent the first tip part toward the first tip part, the first inclined surface is for containment in the first groove of the core, the second nail part has a second inclined surface rising in a direction away from the core end from a portion adjacent the second tip part toward the second tip part, and the second inclined surface is for containment in the second groove of the core.

9. A spool structure according to the claim 6, wherein the flange comprises one integrally molded resin member.

10. A spool structure according to the claim 6, further comprising an image-receiving sheet, the image-receiving sheet for sublimation printing and adapted to be wound around the outer surface of the core.

* * * * *